United States Patent [19]

Colomb et al.

[11] Patent Number: 4,474,239

[45] Date of Patent: Oct. 2, 1984

[54] SAND PLACEMENT

[75] Inventors: Glenn T. Colomb; David L. Farley, both of Lafayette, La.

[73] Assignee: Completion Services, Inc., Lafayette, La.

[21] Appl. No.: 262,369

[22] Filed: May 11, 1981

[51] Int. Cl.[3] ..... E21B 43/04

[52] U.S. Cl. ..... 166/278; 166/51

[58] Field of Search ..... 166/278, 51, 276, 289, 166/290

[56] References Cited

U.S. PATENT DOCUMENTS

| | | | |
|---|---|---|---|
| 2,207,334 | 7/1940 | Reynolds et al. | 166/278 |
| 2,652,117 | 9/1953 | Arendt et al. | 166/278 |
| 2,800,185 | 7/1957 | Teplitz | 166/290 |
| 3,421,586 | 1/1969 | Solum | 166/51 |
| 4,044,832 | 8/1977 | Richard et al. | 166/278 |
| 4,253,522 | 3/1981 | Setterberg | 166/278 |
| 4,270,608 | 6/1981 | Hendrickson et al. | 166/278 |

OTHER PUBLICATIONS

*The Petroleum Engineer,* Jan. 1938, pp. 86–92, Sawdon, Wallace A., "Gravel-Packing Oil Wells".

*Primary Examiner*—Ernest R. Purser
*Assistant Examiner*—Michael Starinsky
*Attorney, Agent, or Firm*—Murray Robinson; Ned L. Conley; David A. Rose

[57] ABSTRACT

Sand placement apparatus includes a well screen assembly and a sand placement tool. The sand placement tool comprises a tubing extension or stinger and a slurry conduit which includes a barrel concentrically disposed around the stinger and a tail pipe extending down therefrom with a valve controlled seal sub at the lower end of the tail pipe. The well screen assembly comprises a production liner including a valve controlled seal socket, a lower or main well screen, a short length of pipe, an upper or tell-tale well screen, and the tubular mandrel of a hook wall packer. By means of this packer the liner is suspended within a well casing. The liner is positioned with its screens inside a perforated section of a well casing. The tool is positioned inside the liner by means of a sleeve anchored to the packer mandrel and adjustably positioned relative to the barrel to deliver sand-water slurry to the liner-casing annulus and build up the sand from the top of the annulus and then downwardly.

23 Claims, 14 Drawing Figures

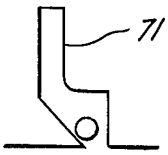
Fig. 8
Fig. 2A
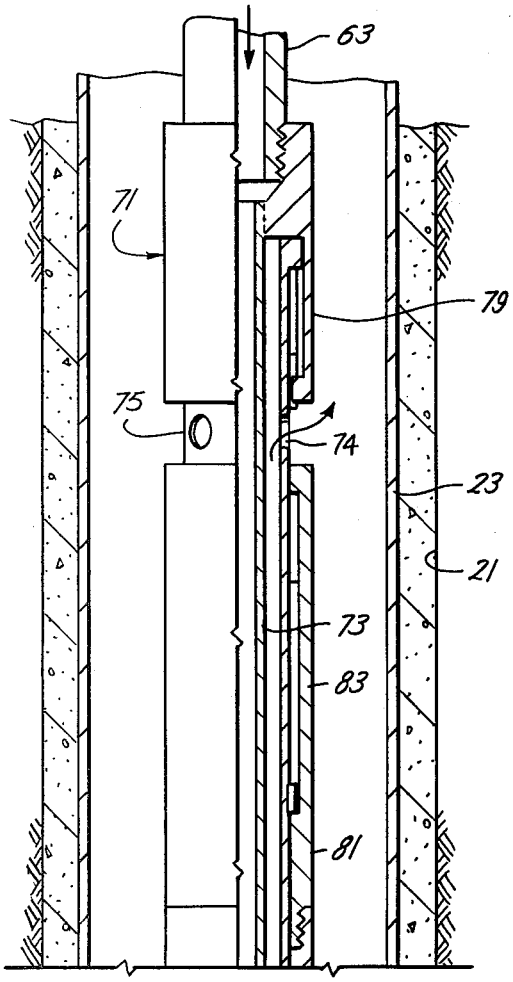
Fig. 3A
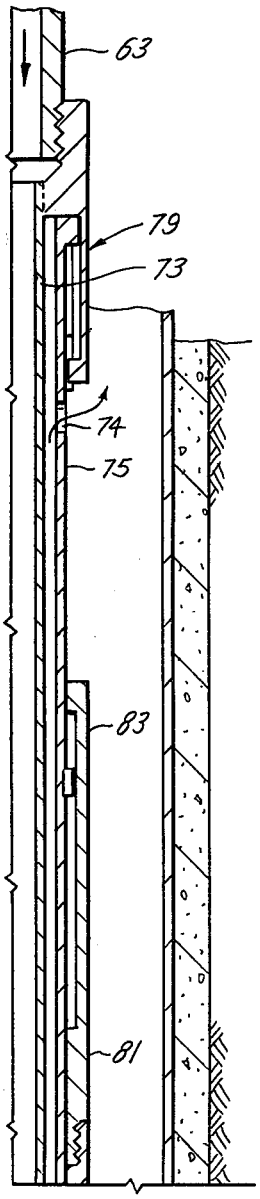
Fig. 4A
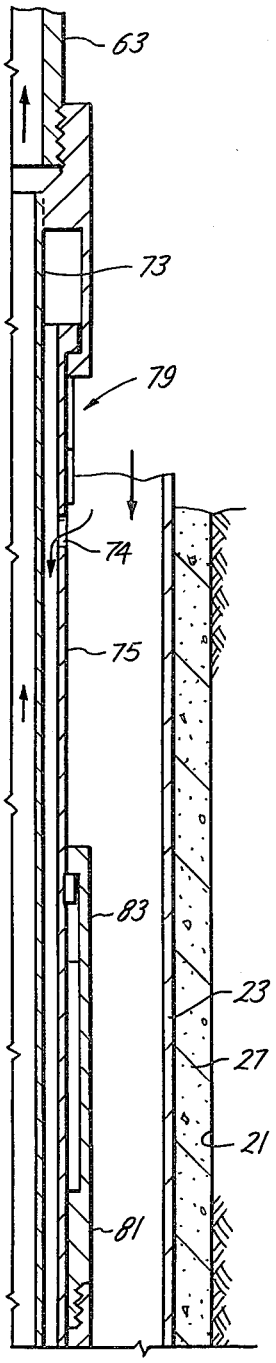

SAND PLACEMENT

CROSS REFERENCE TO RELATED APPLICATION

This application discloses method and apparaus for Sand Placement. Improved apparatus for performance of the method is disclosed in the co-pending application of David L. Farley, Ser. No. 262,714, filed May 11, 1981, entitled Slurry Up Particulate Placement Tool.

BACKGROUND OF THE INVENTION

1. Field of the Invention

This invention relates to well completion and more particularly to method and apparatus for sand packing both the formation to be produced and the annulus between the perforated well casing and a screen liner hung inside the casing by means of a hookwall packer.

2. Certain Prior Art

It is known to effect the foregoing objective with a screen liner assembly including a main screen and a telltale screen therebelow, using a sand placement tool including a length of dual flow passage pipe releasably set inside the well packer to provide for dual flow past the packer. A tailpipe connected to the lower end of the inner tube of the dual pipe and sealed to the liner above and below the main screen prevents flow through the main screen into the annulus between the tail pipe and main screen. A cross-over connecting the upper end of the dual pipe to the tubing diverts tubing flow to the outer flow passage of the dual pipe. Flow is then out the side of the dual pipe, through the packer mandrel below its seal rings, and thence to the casing-line annulus. The tail pipe connected to the lower end of the dual pipe receives liquid returning from the casing-liner annulus through the tell-tale screen below the main or lower screen and delivers the fluid to the inner tube of the dual pipe, which conducts the fluid via the cross over to the casing-tubing annulus. A valve in the cross over can be closed to block such return flow.

With the valve open, sand slurry is delivered from the tubing via the cross-over to the top of the casing-liner annulus. The bottom of the casing-liner annulus is closed by the bottom of the well or a packer. The sand is delivered in a manner to build up sand in the annulus from the bottom of the annulus to the top in between the main screen and casing. The liquid portion of the slurry returns to the tool through the tell-tale screen, which filters out the sand. The liquid exits the tool to the casing-tubing annulus via the cross-over.

After a certain amount of sand is built up in the casing-liner annulus, the cross-over valve is closed so that further slurry is forced into the formation, and to some extent water is squeezed out of the annulus sand into the formation so that the annulus sand is compacted.

Thereafter, the tool is lifted out of the liner, the cross-over valve is opened, and the tool is flushed by reverse circulation. The tool is then withdrawn from the well, following which production tubing is run into the well. A seal tube at the lower end of the tubing is installed in the mandrel of the retrievable permanent packer supporting the screen liner. Such a system is exemplified by the disclosure in the brochure entitled:

"OTIS SINGLE—ZONE SAND-CONTROL SYSTEM"

published by Otis Engineering Corporation and identified as 6865-3M-10/78.

SUMMARY OF THE INVENTION

APPARATUS AND METHOD

According to the invention a sand placement tool comprises a tubing extension or stinger and a slurry conduit which includes a barrel concentrically disposed around the stinger and a tail pipe extending down therefrom. The lower end of the tail pipe is connected via a telescopic joint to a combination sand retention valve and seal sub having a side port. The tool is adapted to be received in a production liner including upper and lower well screens, the liner being suspended within a perforated well casing from the tubular mandrel of a hook-wall packer. A socket with a valve controlled lateral port disposed at the lower end of the liner receives the seal sub. A bull plug closes the lower end of the liner.

The liner and packer are run in with the tool on tubing and the packer is set. Fluid is pumped down through the tubing, through the stinger, and into and down the tail pipe, through the seal and socket ports, and up outside the liner. The liquid in the fluid flows in through the upper screen, by-passes the packer via the barrel and returns to the surface via the casing-tubing annulus. Sand in the fluid is left outside the screens, the sand accumulating first adjacent the upper screen and then progressing down around the lower screen. Elevation of the tubing resets the tool to allow liquid to enter the barrel through the lower screen as well as the upper screen so that the sand-water ratio outside both of the screens will be increased and the sand will be compacted. Further elevation of the tubing allows reverse circulation of flushing fluid down the casing-tubing annulus and the barrel and up the stinger and tubing, to clear sand out of the barrel and stinger and tubing. Final elevation of the tubing frees the tool from the liner and the tool is removed from the well. Production tubing carrying a seal tube at its lower end is then run into the well, the seal tube is seated in the packer or liner, and the well is produced.

According to the method of the invention, sand is delivered from the tubing to the lower end of the annulus around the main screen and is returned to the tool via a tell-tale screen located in the upper part of the liner, the sand accumulating first at the top of the annulus and thereafter progressing downwardly. In the final stage of sand placement, the main screen is open to liquid flow as well as the tell-tale screen.

ADVANTAGES

Four advantages of the present invention over the above referred to known system may be mentioned:

First of all, the sand in place should be of more uniform density, resulting from the fact that the weight of the sand acts oppositely from the force of the moving liquid which carries the sand, whereas in the previously known method both the sand weight and fluid force act downwardly, tending toward greater compaction at the lower part of the sand volume and lower density at the top.

Secondly, in the case of an inclined well bore, with the liner lying against the low side, there should be less likelihood of all the sand accumulating on a single side of the liner, or, in the case of a vertical hole, of the sand forming a helix around the liner with open spaces between the turns of the helix.

Third, in the method of the invention, since the main screen is open to liquid flow in the final stage of sand placement, liquid is easily and uniformly squeezed out of the sand around the main screen.

Fourth, the method of the invention eliminates the need for a cross-over and cross-over valve in the sand placement tool.

Other objects and advantages of the invention will appear as the description thereof proceeds.

COMPARISON WITH OTHER METHODS AND APPARATUS

It is recognized that both in the cementing of well pipe in a well bore and in the grouting of pilings used in offshore drilling platforms, it is known to pump the cement slurry upwardly during the placement. However, this differs from the placement of sand wherein the solids-liquid ratio of the slurry is changed during placement. Despite the knowledge of cementing practices, the sand placement practice known to be currently in use involve slurry flow from the top down, for whatever reason.

SEARCH

A search of the United States patents relative to the subject invention revealed the following U.S. patents:

U.S. Pat. No. Re 25,323—Johnston et al
U.S. Pat. No. 2,760,581—Johnston et al
U.S. Pat. No. 3,223,159—Brown
U.S. Pat. No. 3,330,360—Young
U.S. Pat. No. 3,583,487—Block
U.S. Pat. No. 3,710,862—Young et al
U.S. Pat. No. 3,818,986—Abney et al
U.S. Pat. No. 3,830,294—Swanson, Jr.
U.S. Pat. No. 3,831,677—Mullins
U.S. Pat. No. 3,901,318—Fortenberry
U.S. Pat. No. 3,926,409—Abney
U.S. Pat. No. 3,960,366—Abney
U.S. Pat. No. 3,963,076—Winslow
U.S. Pat. No. 3,987,854—Callihan et al
U.S. Pat. No. 4,049,055—Brown Other patents relevant to this subject include those classified and cross-referred into class 166 subclass 278 of the United States Patent Office.

A review of the above patent classification reveals the following patents of interest.

U.S. Pat. No. 1,944,433—Manning
U.S. Pat. No. 1,975,162—Layne
U.S. Pat. No. 2,083,625—White
U.S. Pat. No. 2,154,461—Layne
U.S. Pat. No. 2,198,573—Davis et al
U.S. Pat. No. 2,205,422—Layne
U.S. Pat. No. 2,207,334—Reynolds et al
U.S. Pat. No. 2,213,962—Layne
U.S. Pat. No. 2,213,987—Layne
U.S. Pat. No. 2,216,037—Layne
U.S. Pat. No. 2,223,374—Layne
U.S. Pat. No. 2,349,062—Uren
U.S. Pat. No. 2,652,117—Arendt et al
U.S. Pat. No. 2,905,254—De Priester
U.S. Pat. No. 3,062,284—Brown The above patents, e.g. to Reynolds et al and Layne '461, show early forms of gravel packing by both normal and reverse circulation.

More recent patents of interest are the following:

U.S. Pat. No. 3,627,046—Miller
U.S. Pat. No. 3,726,343—Davis
U.S. Pat. No. 3,850,246—Despujois
U.S. Pat. No. 3,913,676—Barber
U.S. Pat. No. 3,952,804—Smyri
U.S. Pat. No. 4,018,284—Perkins
U.S. Pat. No. 4,044,832—Richard There may be other relevant prior art to be found in other classifications of the U.S. Patent Office besides the patents listed above, e.g. class 166, subclasses 51, 121, 123, 131, 143, 184, 212, 217, 313, 334. See U.S. Pat. Nos. 2,014,770—Layne 2,096,904—Layne.

The Composite Catalogue of Oil Field Equipment and Services published every year or two by Gulf Publishing Company describes many gravel pack tools and services offered commercially. See for example the following:

Layne & Bowler, 1964, p. 2906
Brown Oil Tools, Inc., 1966, p. 949
Brown Oil Tools, 1968, p. 862, 828 (refers to U.S. Pat. No. 3,072,204)
B & W, Inc., 1968, page 318
TIW, 1968, page 4734
Kirk Shirley Oil Tools, 1970, page 4252
Baker, 1972, p. 378–383

BRIEF DESCRIPTION OF THE DRAWINGS

For a detailed description of a preferred embodiment of the invention, reference will now be made to the accompanying drawings wherein:

FIGS. 2A, 2B and 2C, together referred to as FIG. 2 show a vertical half section through a sand placement system embodying the invention, showing the sand placement tool in sand placement position;

FIGS. 3A, 3B and 3C, together referred to as FIG. 3, are views similar to FIGS. 2A, 2B and 2C, but showing the parts in sand compacting position;

FIGS. 4A, 4B and 4C, together referred to as FIG. 4, are views similar to FIGS. 2A, 2B and 2C showing the parts in the reverse circulation, tool barrel and tubing flushing, position;

FIG. 8 is a fragmentary side elevation showing a J-slot and pin limiting relative motion of the stinger and slurry conduit parts of the sand placement tool.

DESCRIPTION OF PREFERRED EMBODIMENT

DERRICK

Figures 1, 5, 6, 7:
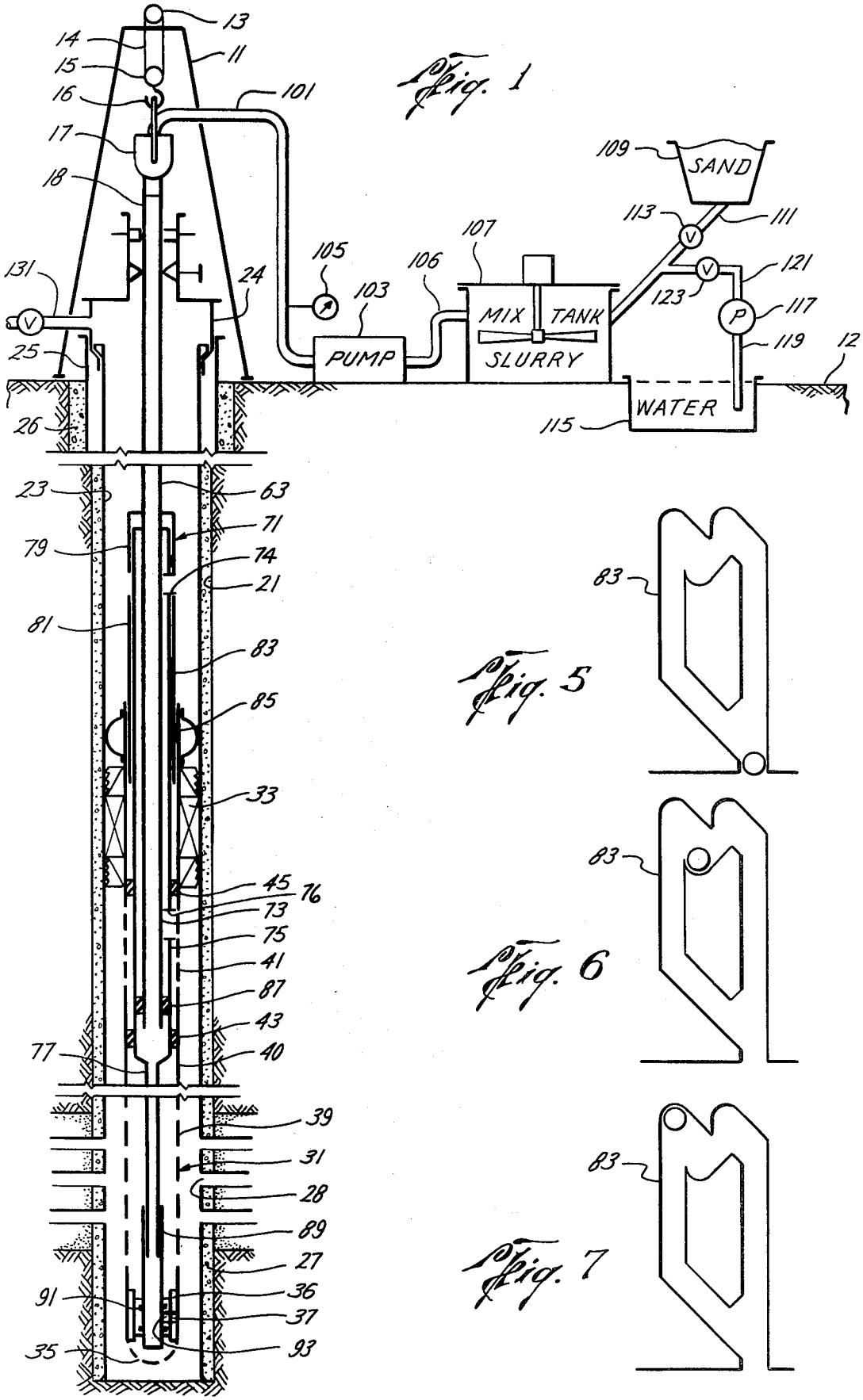
FIG. 1 is a schematic view showing a well in which sand is being placed according to the method and with the apparatus of the invention.
FIGS. 5, 6 and 7 are fragmentary side elevations showing a double J-slot and pin limiting relative motion of the slurry conduit part of the sand placement tool and the barrel sleeve connected to the screen liner, the J-slot and pin being shown in different positions corresponding to FIGS. 2, 3 and 4 respectively.

Referring now to FIG. 1 there is shown a well site whereat is located surface equipment including a derrick 11 supported on the earth's surface 12. The derrick includes crown block 13, cable 14 and travelling block 15. A hook 16 carried by the travelling block suspends a pipe swivel 17. A string of tubing or other pipe 18 is connected to the rotor of the swivel and is suspended thereby in earth bore 21.

WELL

Within earth bore 21 is disposed well casing 23, suspended by well head 24, the latter being connected to the top of surface pipe 25 held in place by cement 26.

The lower end of the casing is secured to the lower end of the earth bore by cement 27. Casing 23 is perforated at 28 adjacent to a portion of the earth whose fluid is to be extracted.

WELL SCREEN

Figure 2B:
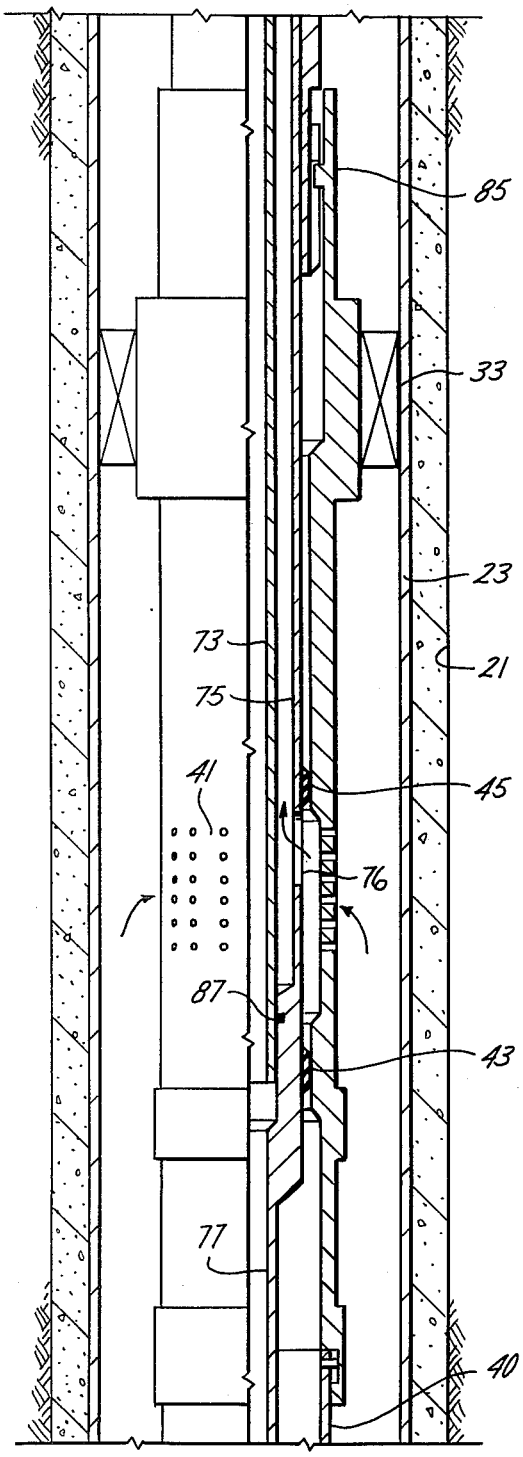
Figure 3B:
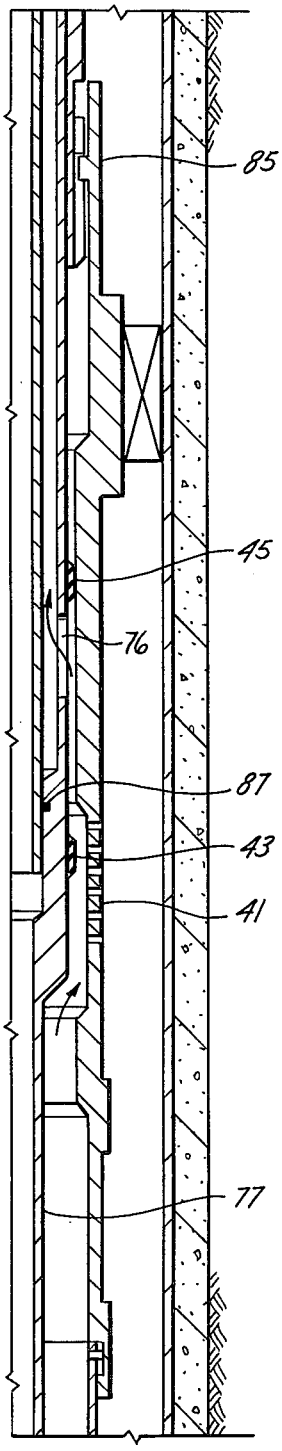
Figure 4B:
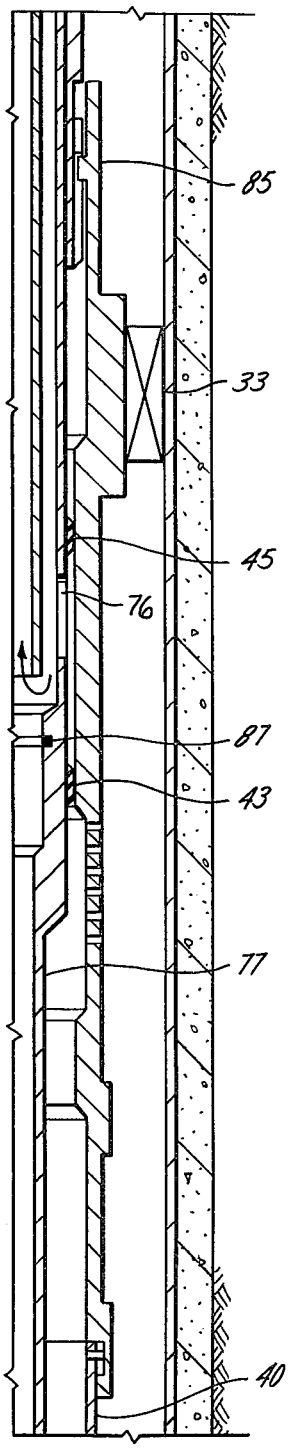
Figure 2C:
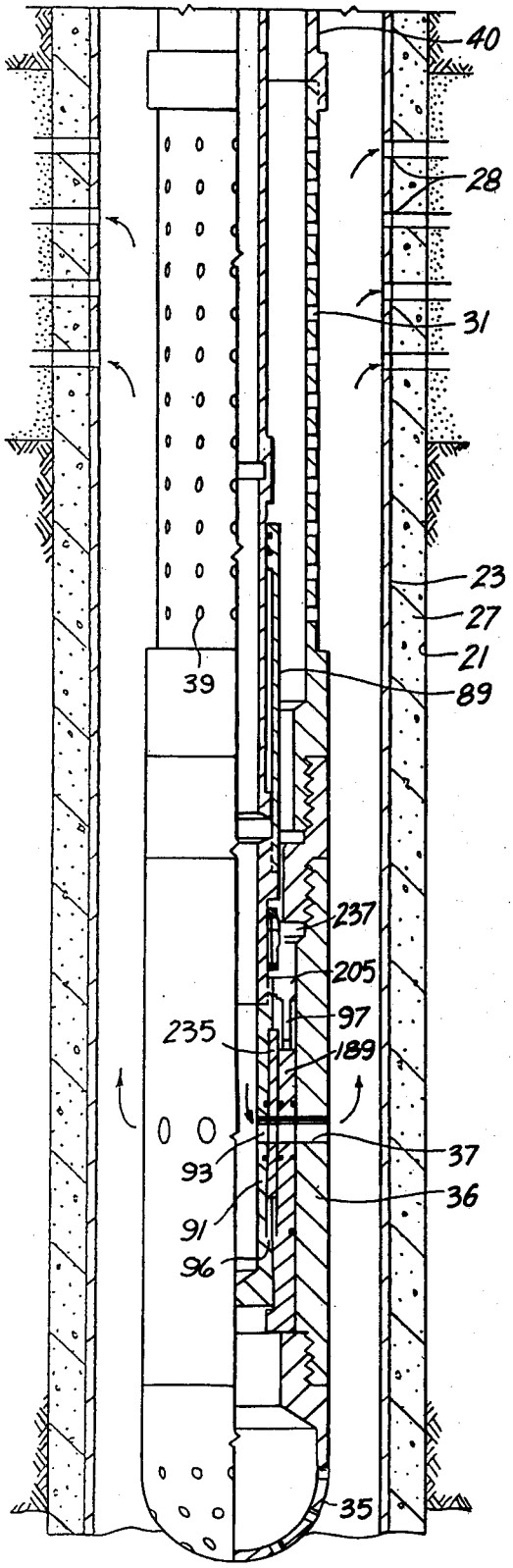
Figure 3C:
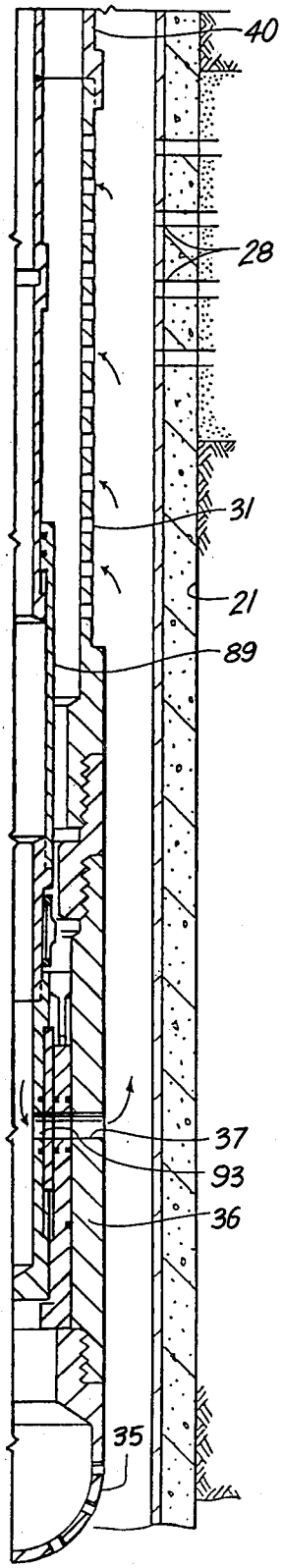
Figure 4C:
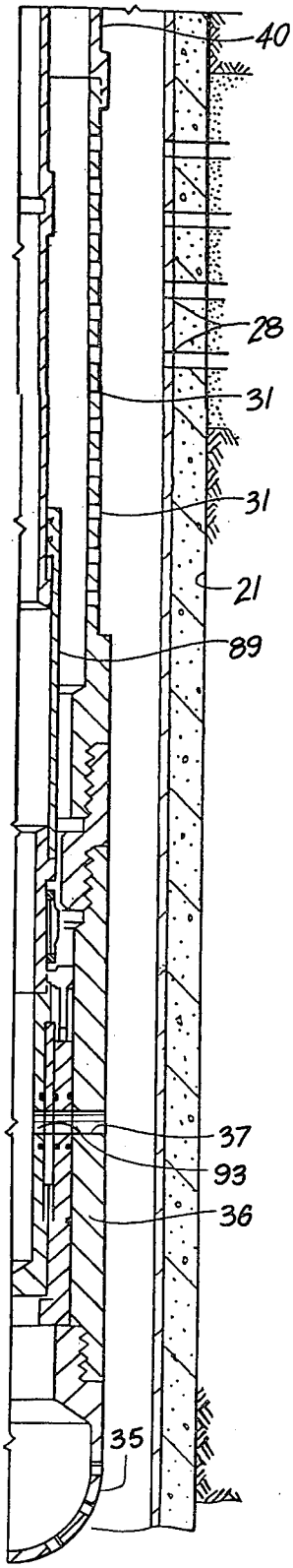

Referring now also to FIGS. 2, 3, and 4, adjacent the lower end of casing 23 opposite perforations 28 and extending above and below the perforations is a screen liner 31 suspended in the casing by hookwall packer 33. Packer 33 is shown only schematically since any conventional isolation packer is satisfactory.

The packer mandrel forms the upper end of the liner. Secured to the lower end of the liner is a perforated bull plug 35. Just above the bull plug the liner includes a seal socket 36, there being a radial port 37 therethrough. Connected above the seal socket is the lower or main screen 39 which is connected by pipe 40 to upper or tell-tale screen 41. Inside the liner just below and above screen 41 are annular seals 43,45.

SAND PLACEMENT TOOL

Screwed to the lower end of pipe 63 is a sand placement tool 71. Tool 71 includes a stinger 73 and a slurry conduit comprising a barrel 75 and tailpipe 77. The barrel is connected at its upper end to the upper end of the stinger by a J-slot controlled slip joint 79 barrel 75 is provided with lateral ports 74 and 76, at its upper and lower ends.

A sleeve 81 is connected to the exterior of the upper part of the barrel by a double J-slot slip joint 83. The exterior of the sleeve is connected to the interior of the packer mandrel by J-slot connector 85.

The exterior of the barrel seals with liner seals 43, 45 in the position shown in FIG. 1. The lower end of the barrel has an interior seal 87 which receives and seals with the lower end of the stinger in the position shown in FIG. 1.

There is a telescopic slip joint 89 in the lower end of the tail pipe. The distal end of the tailpipe is provided with a seal sub 91 which is received in seal socket 36 of the liner, in the position shown in FIG. 1. A port 93 in the seal sub communicates with port 37 in the seal socket when valve sleeves 189,235 are in the open position as shown in FIGS. 2 and 3.

SLURRY SUPPLY

To supply slurry to tubing string 18, a high pressure flexible hose line 101 is connected to the stationary body of pipe swivel 17. Hose line 101 is connected to the outlet of slurry pump 103. A pressure gauge 104 is connected to hose line 101 at the pump outlet to indicate slurry pressure. Pump 103 receives slurry via pipe 106 from slurry mixing tank 107. The latter is supplied with sand from bin 109 via pipe 111 controlled by valve 113. Water from pit 115 is fed by pump 117 via pipes 119 and 121 and valve 123 to mixing tank 107. This equipment is conventional and is illustrated schematically.

METHOD OF USE OF THE SAND PLACEMENT APPARATUS

(a) PLACEMENT OF SAND IN ANNULUS

To use the apparatus of the invention, the production tubing, or a work string of tubing, is run into the cased well, with the sand placement tool at the lower end. The liner is attached to the tool so that both are run in together. At the desired liner level the packer is set. With the slurry conduit in its lowermost or sand placement position relative to the liner, and with the stinger seated in the seal at the lower end of the barrel, as shown in FIGS. 1, 2, 5 and 8, slurry is pumped down the tubing, stinger and tail pipe, out through the radial ports in the seal sub and seal socket, and up the casing-liner annulus. Fluid ahead of the slurry flows from the casing-liner annulus through the tell-tale screen and the lower port in the barrel into the barrel-stinger annulus and out through the port near the top of the barrel above the packer into the casing-tubing annulus. The sand component of the slurry is filtered out by the tell-tale screen and accumulates in the line-casing annulus, building downward from the top of the annulus adjacent the packer. The liquid component exits the annulus via side outlet 131 in well head 24, which may dump back into pit 115 or be wasted.

(b) PLACEMENT OF SAND IN FORMATION

When a sand cake builds up on the tell-tale screen sufficient to impede sand flow; further pumping of slurry forces slurry through the casing perforations into the formation.

(c) REPLACEMENT OF RESIDUAL WATER BY SAND

After the sand capacity of the casing-liner annulus, perforations, and formation volume is initially satisfied, further pumping of slurry increases the sand-water ratio in the sand placement volume, the sand being filtered out of the additional slurry by the previously placed sand held by the formation and the tell-tale screen, while liquid or fluid passes through the tell-tale screen. The additional sand displaces the water or fluid remaining in the previously placed sand, the displaced water also flowing out through the tell-tale screen.

(d) FINAL SQUEEZE

When a certain pressure is reached, the tubing may be elevated as shown in FIGS. 3 and 6 to move the lower exterior seal on the barrel off the liner seat below the tell-tale screen.

The upper barrel seal continues to block flow between the barrel and the upper part of the liner which would sand up the releasable J-slot connection between the barrel sleeve and the packer mandrel. Further pumping of slurry is then easier because liquid can pass through the main screen into the liner-tail pipe annulus, join the liquid from the tell-tale screen and flow out via the barrel stinger annulus. Further increase of the sand-water ratio in the sand-placement volume is thereby achieved.

The foregoing step (d) may be omitted if desired, and the operator may go directly to step (e).

(e) FLUSHING OUT SAND PLACEMENT TOOL

When the desired sand-water ratio is reached, as indicated by the volume of slurry pumped and the rise in pump pressure, the tubing is elevated sufficiently to raise the lower external seal on the barrel into the upper seat in the liner, above the tell-tale screen, as shown in FIGS. 4 and 7, thus blocking flow through the port in the lower end of the barrel. At the same time the lower end of the stinger is withdrawn from the seal nipple at the lower end of the barrel, enabling fluid to flow from the barrel-stinger annulus into the lower end of the stinger. Pump connections at the surface are then rearranged to effect reverse circulation. Flushing fluid is pumped down the casing-tubing annulus, through the radial port in the top of the barrel, down the barrel-stinger annulus, and up through the stinger into the tubing, thus clearing slurry out of all parts of the tool above the tail pipe.

(f) REMOVAL OF SAND PLACEMENT TOOL

The tubing is then raised to free the barrel sleeve from the packer mandrel whereupon the tool is lifted out of the liner and withdrawn from the well. The valve sleeve 235 closes port 93 to retain excess sand left in the tail pipe, and valve sleeve 189 closes port 37 to prevent production through the slurry port 37 in the seal socket.

(g) FOOTVALVE

During steps (a), (b) and (c) described above, slip joint 89 allows axial movement of the upper part of the tail pipe, as needed to control the flow passages in the upper part of the tool, without disturbing the inner footvalve (comprising sub 91 and sleeve 235) and the outer foot valve (comprising socket 36 and sleeve 189). The inner foot valves therefor remain open. The inner foot valve is held against accidental movement by a collet connection to the lower end of the liner, such connection comprising a plurality of circumferentially disposed spring bars 237 each having a radially extending lug or key received in annular groove 237 in the liner.

(h) PRODUCTION

A string of production tubing, having a seal tube at its lower end, is then run into the well. The seal tube is positioned in the packer mandrel and can be releasably retained by a J-slot connection. The well is then produced. Port 37 was closed by valve sleeve 94 when the tool was removed so there is no production through port 37, only through the screens and perforated bull plug.

While a preferred embodiment of the invention has been shown and described, modifications can be made by one skilled in the art without departing from the spirit of the invention. The embodiment shown is the one preferred at the time the invention was made. An improved form of the invention is shown in the United States patent application of David L. Farley entitled Slurry Up Particulate Placement Tool filed contemporaneously herewith. For example the seal sub and socket and associated valving there shown can be used in place of these herein disclosed.

We claim:

1. Sand placement method comprising:

placing a production liner including upper and lower well screens within a well passage, packing off the annulus between the liner and passage above the screens, blocking flow elsewhere out of the liner of fluid that has passed through the lower screen from the outside of the screen to the interior thereof, flowing solid-liquid slurry down tubing placed inside the passage to a level below the lower screen and up the annulus between the liner and passage and to the upper screen with the liquid continuing on through the upper screen into the liner-tubing annulus, whereby solids filter out of the slurry at the upper screen and build downward around the upper screen, and continuing said flowing of solid liquid slurry down said tubing and up said annulus to the solids previously filtered out, with the liquid flowing through said solids to and through said upper screen, while blocking flow of liquid upwardly out of the liner from within the liner that is at the level of the lower screen, whereby all the liquid entering the liner tubing annulus as aforesaid flows through said upper screen and solids build downward around the outside of the liner and lower screen counter to the upward direction of liquid flow to the upper screen.

2. Method of claim 1 followed by:

continuing said flowing while monitoring the pressure of the slurry being introduced into the tubing, noting an increase in said pressure as indicative of a sand build-up outside said upper screen, and continuing said flowing for a period of time after said pressure increase, said period being long enough to introduce a desired volume of sand into said annulus between the liner and passage.

3. Method of claim 2, followed by opening a fluid path from the bore-liner annulus through a lower screen in said liner and through the tubing-liner annulus upwardly past the upper screen, and flowing further solid-liquid slurry down the tubing and up the liner-passage annulus to the lower screen, with liquid flowing through the lower screen into the liner tubing annulus and with further liquid flowing through said sand introduced into said liner-passage annulus and said upper screen into said liner-tubing annulus and with further sand accumulating in said liner-passage annulus.

4. Method of claims 1, 2 or 3 preceded by:

casing a wellbore to form said well passage, perforating said casing to form perforations therein, said liner being placed at the level of said perforations, and continuing the flowing of sand-liquid slurry upwardly outside of the liner for a period of time long enough to introduce a desired volume of sand into the formation through said perforations.

5. Method of claim 1, 2 or 3 followed by flowing fluid down the tubing-passage annulus and past the point where the annulus is packed off as aforesaid and through said tubing-liner annulus to the lower end of said tubing and into said tubing and up said tubing.

6. Method of claim 5 followed by:

closing a sliding valve at the lower end of said tubing and withdrawing said tubing.

7. Method of claim 6 including:

contemporaneously with said closing of said sliding valve at said lower end of the tubing, also closing a sliding valve which closes the path through which said slurry flowed from the tubing to the liner-passage annulus at said level below the screen, and after said tubing is withdrawn, installing in said passage production tubing in communication with said liner.

8. Apparatus for sand placement comprising:

a tubular stinger having means at its upper end for making connection with a string of tubing so that the stinger will form a continuation of the tubing, a tubular slurry conduit concentric with the stinger including an upper barrel around the outside of the stinger and connected thereto, forming a barrel-stinger annulus therebetween, said slurry conduit further including a tailpipe connected to said barrel extending down below the stinger, the bore of said stinger forming a flow path from the tubing, through the stinger, and exiting into the interior of said tailpipe, annular seal means sealing between said barrel and stinger, said annular seal means being a different means than said means at the upper end of the stinger for making connection with a string of tubing, said barrel further including lower and upper lateral passage means through said barrel from the stinger-barrel annulus to the barrel-wellbore annulus above said seal means, said seal means being an annular elastomeric seal means and being positionable in a sealing position sealing between said stinger and barrel and a non-sealing position in which the seal means is ineffective to seal between said stinger and barrel, said slurry conduit being connected to said stinger by lost motion means whereby said stinger can be positioned in first and second positions relative to said conduit, said seal means being in sealing position when said lost motion means is in said first position, said seal means being in said non-sealing position when said lost motion means is in said second position.

9. Apparatus according to claim 8 including:

a sleeve around said barrel adapted to be anchored in a packer mandrel, said barrel being adjustably positionable relative to said sleeve.

10. Apparatus according to claim 8, said seal means comprising a seal nipple connecting the barrel and tail pipe, said seal nipple having a socket telescopically receiving the lower end of said stinger, said lost motion connection comprising a telescopic connection with a J-slot and pin limiting relative motion of the barrel and stinger with said first and second positions corresponding to the motion limits imposed by the J-slot and pin.

11. Apparatus according to claim 1 or 10, the lower end of said tailpipe being adapted for engagement with a seal socket at the lower end of a well liner, said apparatus including:

valve means at the lower end of said tailpipe for closing the tailpipe by the act of withdrawing the tailpipe from such seal socket.

12. Apparatus according to claim 11, including a liner in which said stinger and conduit are received, said line including an upper tell-tale screen, a lower main screen, said seal socket, and a ported bull plug closing the lower end of the liner, said seal socket having a lateral port therethrough and valve means operable by withdrawal of said tail pipe therefrom to close said port.

13. Apparatus according to claim 12, said valve means at the lower end of said tail pipe comprising an inner sub and an outer sleeve, said inner sub having an external shoulder at its lower end to engage said sleeve upon the lifting of said sub, said seal socket valve means having an inner sleeve, said liner sleeve having collet fingers on its upper end, said collet fingers being engaged by the upper edge of the outer valve sleeve of the inner sub upon lifting of the sub, whereby the seal socket valve is closed, said collet fingers engaging a groove on the upper end of the inside of the seal socket, thus holding the valve in a closed position.

14. Apparatus for sand placement comprising:

a tubular stinger having means at its upper end for making connection with a string of tubing so that the stinger will form a continuation of the tubing, a tubular slurry conduit concentric with the stinger including an upper barrel around the outside of the stinger and connected thereto, forming a barrel-stinger annulus therebetween, said slurry conduit further including a tailpipe connected to said barrel extending down below the stinger, the bore of said stinger forming a flow path from the tubing, through the stinger, and exiting into the interior of said tailpipe, annular seal means sealing between said barrel and stinger, said annular seal means being a different means than said means at the upper end of the stinger for making connection with a string of tubing, said barrel further including lower and upper lateral passage means through said barrel from the stinger-barrel annulus to the barrel-wellbore annulus above said seal means, and upper and lower seals on the outer periphery of said barrel, above and below said lower lateral passage means, adapted for engagement with sealing surfaces in a well liner above and below a tell-tale screen in such well liner.

15. Apparatus for sand placement comprising:

a tubular stinger having means at its upper end for making connection with a string of tubing so that the stinger will form a continuation of the tubing, a tubular slurry conduit concentric with the stinger including an upper barrel around the stinger forming a barrel-stinger annulus therebetween and further including a tail pipe extending down below the stinger, seal means sealing between said barrel and stinger, said barrel further including lower and upper lateral passage means through said barrel above said seal means, upper and lower seals on the outer periphery of said barrel, above and below said lower lateral passage means, adapted for engagement with sealing surfaces in a well liner above and below a tell-tale screen therein, a sleeve around said barrel adapted to be anchored in a packer mandrel from which such screen is hung, said sleeve being adjustably positioned relative to said barrel, in one position said seals, respectively to engage said seating surfaces above and below said screen, in a second position one seal to engage the seating surface above the screen and the other to be out of engagement with the seating surfaces and in a third position both seals to be above the screen and at least one in engagement with the upper seating surface.

16. Apparatus according to claim 15 including said well liner with tell-tale screen and sealing surfaces above and below the tell-tale screen.

17. Apparatus according to claim 16 including a double J-slot and pin limiting relative motion of said sleeve and said barrel with said 3 positions corresponding to the motion limits imposed by the double J-slot and pin.

18. Apparatus for sand placement comprising:

a well liner having a tell tale screen therein, a tubular stinger having means at its upper end for making connection with a string of tubing so that the stinger will form a continuation of the tubing, a tubular slurry conduit concentric with the stinger including an upper barrel around the stinger forming a barrel-stinger annulus therebetween and further including a tail pipe extending down below the stinger, seal means sealing between said barrel and stinger, said barrel further including lower and upper lateral passage means through said barrel above said seal means, upper and lower annular seals on the exterior of said barrel, above and below said lower lateral passage means, adapted for engagement with seating surfaces in said well liner above and below the tell-tale screen therein, means releaseably connecting said barrel to the well liner, providing for limited motion of the barrel relative to the well liner, said connection including a double J-slot and pin limiting relative motion of the barrel and the well liner, said double J-slot having 3 positions, in one position the seals above and below said lower port in said barrel being sealingly engaged with the seating surfaces above and below said tell-tale screen, in the second position the seal above said port in said barrel being sealingly engaged with the seating surface above said tell-tale screen while the seal below said port is incapable of sealing, and in the third position both the seals above and below said port are sealingly engaged with the seating surface above said tell-tale screen.

19. Method of sand placement comprising:

assembling in the top of a wellbore;

a well liner including a tell-tale screen, a screen below the tell-tale screen, a seal socket below the screen, said seal socket having a gravel port, and a ported bull plug below the seal socket, the well liner being extended through and connected at its upper end to a packer, the well liner being attached to a sand placement tool by means of a J-slot, said sand placement tool including a barrel, lateral ports in the upper and lower end of the barrel, a stinger hanging concentrically within the barrel and movable relative to the barrel, a double J-slot to control motion between the barrel and the stinger, a tail pipe attached to the lower end of the stinger, a seal sub below the tail pipe extending into the seal socket, said sand placement tool being adapted for connection to a tubing string, running the sand placement tool and liner into the well bore on a string of tubing, with the sand placement tool in its sand placement position, setting the packer in the well bore, pumping slurry down the tubing, stinger and tail pipe, through the gravel ports in the seal sub, fluid from the slurry flowing through the tell-tale screen and into the lower lateral port in the barrel, up the stinger-barrel annulus, past the packer, out the upper lateral port in the barrel into the bore tubing annulus, then to the surface, noting an increase in pressure when filter cake covers the tell-tale screen, lifting up on the tubing string until there is resistance on the string, then lowering the string until it meets resistance again thereby moving the barrel up relative to the liner and opening a flow path through the lower screen, continuing to pump slurry down the tubing string to place sand in the liner-bore annulus, lifting up on the tubing string until there is resistance on the tubing string, thereby closing the return flow path, continuing to pump slurry down the tubing to squeeze slurry into the formation, rotating the drill string clockwise and lifting up until resistance is met, pumping flushing fluid down the bore-tubing annulus, through the barrel-stinger annulus and up the stinger into the tubing;

rotating the drill string and lifting up to remove the sand placement tool, running in production tubing with a seal tube on the end, connecting the seal tube to the liner, and producing the well.

20. Apparatus for sand placement comprising:

a tubular stinger having means at its upper end for making connection with a string of tubing so that the stinger will form a continuation of the tubing, a tubular slurry conduit concentric with the stinger including an upper barrel around the outside of the stinger and connected thereto, forming a barrel-stinger annulus therebetween, said slurry conduit further including a tailpipe connected to said barrel extending down below the stinger, the bore of said stinger forming a flow path from the tubing, through the stinger, and exiting into the interior of said tailpipe, annular seal means sealing between said barrel and stinger, said annular seal means being a different means than said means at the upper end of the stinger for making connection with a string of tubing, said barrel further including lower and upper lateral passage means through said barrel from the stinger-barrel annulus to the barrel-wellbore annulus above said seal means, the lower end of said tail pipe being adapted for engagement with a seal socket at the lower end of a well liner, said apparatus further including:

valve means at the lower end of said tailpipe for closing the tailpipe by the act of withdrawing the tailpipe from such seal socket.

21. Apparatus according to claim 20, including a liner in which said stinger and conduit are received, said liner including an upper tell-tale screen, a lower main screen, said seal socket, and a ported bull plug closing the lower end of the liner, said seal socket having a lateral port therethrough and valve means operable by withdrawal of said tail pipe therefrom to close said port.

22. Apparatus according to claim 21, said valve means at the lower end of said tail pipe comprising an inner sub and an outer sleeve, said inner sub having an external shoulder at its lower end to engage said sleeve upon the lifting of said sub, said seal socket valve means having an inner sleeve, said liner sleeve having collet fingers on its upper end, said collet fingers being engaged by the upper edge of the outer valve sleeve of the inner sub upon lifting of the sub, whereby the seal socket valve is closed, said collet fingers engaging a groove on the upper end of the inside of the seal socket, thus holding the valve in a closed position.

23. Apparatus for sand placement comprising:

a tubular stinger having means at its upper end for making connection with a string of tubing so that the stinger will form a continuation of the tubing for conducting slurry downwardly therefrom, a tubular slurry conduit concentric with the stinger including an upper barrel around the outside of the stinger and connected thereto, forming a barrel-stinger annulus therebetween for conducting slurry upwardly outside of the stinger, said slurry conduit further including a tailpipe connected at its upper end directly to the lower end of said barrel and extending down below the stinger for conducting slurry downwardly from said stinger, the lower end of said stinger terminating above the upper end of said tailpipe, the bore of said stinger forming a flow path from the tubing, through the stinger, and exiting into the interior of the lower end of the barrel adjacent where it is connected to said tailpipe, annular seal means sealing between said barrel and stinger to separate slurry flowing downwardly in said tailpipe portion of said slurry conduit from slurry flowing upwardly in said upper barrel portion of said slurry conduit, said annular seal means being a different means than said means at the upper end of the stinger for making connection with a string of tubing, said barrel further including above said seal means lower and upper lateral passage means through said barrel from the stinger-barrel annulus to the barrel-wellbore annulus, whereby when said apparatus is disposed in a well inside a well packer, said barrel-stinger annulus provides a flow path for conducting slurry upwardly from below such packer to above such packer, said slurry conduit thus serving as a bi-directional flow conductor, i.e. down flow in the tailpipe portion and upflow in the barrel portion.

* * * * *

UNITED STATES PATENT AND TRADEMARK OFFICE

CERTIFICATE OF CORRECTION

PATENT NO. : 4,474,239
DATED : OCTOBER 2, 1984
INVENTOR(S) : GLENN T. COLOMB
DAVID L. FARLEY

It is certified that error appears in the above—identified patent and that said Letters Patent is hereby corrected as shown below:

Column 1, line 34; change "casing-line" to -- casing-liner --.

Column 3, line 21; change "involve" to -- involves --.

Column 5, line 27; change "79 barrel" to -- 79. Barrel --.

Column 5, line 50; change "104" to -- 105 --.

Column 6, line 12; change "line-casing" to -- liner-casing --.

In The Claims

Claim 11
Column 9, line 42; change "claim 1" to -- claim 8 --.

Claim 12
Column 9, line 50; change "line" to -- liner --.

Signed and Sealed this

Sixteenth Day of July 1985

[SEAL]

*Attest:*

DONALD J. QUIGG

*Attesting Officer* *Acting Commissioner of Patents and Trademarks*